US005237908A

United States Patent [19]

Kropp

[11] Patent Number: 5,237,908

[45] Date of Patent: Aug. 24, 1993

[54] CONTROL SYSTEM FOR THE LOAD-INDEPENDENT DISTRIBUTION OF A PRESSURE MEDIUM

[75] Inventor: Walter Kropp, Sulzbach, Fed. Rep. of Germany

[73] Assignee: Linde Aktiengesellschaft, Fed. Rep. of Germany

[21] Appl. No.: 791,570

[22] Filed: Nov. 12, 1991

[30] Foreign Application Priority Data

Nov. 17, 1990 [DE] Fed. Rep. of Germany ..... 4036720

[51] Int. Cl.[5] ..... F15B 11/16

[52] U.S. Cl. ..... 91/518; 91/531; 91/446

[58] Field of Search ..... 60/426, 427; 91/446, 91/518, 531

[56] References Cited

U.S. PATENT DOCUMENTS

| | | | |
|---|---|---|---|
| 3,982,469 | 9/1976 | Bianchetta | 91/518 |
| 4,617,854 | 10/1986 | Kropp | 91/517 |
| 5,000,001 | 3/1991 | Christensen et al. | 91/518 |
| 5,067,389 | 11/1991 | St. Germain | 91/446 |

FOREIGN PATENT DOCUMENTS

| | | |
|---|---|---|
| 89/11041 | 11/1989 | European Pat. Off. . |
| 3422165 | 8/1989 | Fed. Rep. of Germany . |

*Primary Examiner*—Edward K. Look
*Assistant Examiner*—F. David Lopez
*Attorney, Agent, or Firm*—Webb, Burden, Ziesenheim & Webb

[57] ABSTRACT

A hydraulic system including a pump having a discharge line and a number of hydraulic energy consumers connected to the pump discharge line. A controller for the load-independent distribution of a pressure medium from the pump to the consumers includes a multiway valve located in the discharge line between the pump and each consumer to actuate the consumers. A pressure compensator for determining the flow of pressure medium to each multiway valve is located in the discharge line upstream of each multiway valve. Each pressure compensator is actuated as a function of a first pressure difference resulting from the pressure upstream of a multiway valve and the pressure downstream of the multiway valve and of a second pressure difference resulting from the discharge pressure from the pump and the highest load pressure of the consumers. At least one pressure difference of at least one pressure compensator is adjustable.

9 Claims, 1 Drawing Sheet

CONTROL SYSTEM FOR THE LOAD-INDEPENDENT DISTRIBUTION OF A PRESSURE MEDIUM

BACKGROUND OF THE INVENTION

The invention is directed to a control system for load-independent distribution of a pressure medium to a number of different hydraulic energy consumers which are connected to one hydraulic pump and actuated by multiway valves. A pressure compensator for determining the flow of pressure medium to the multiway valve is installed upstream of each multiway valve and is actuated as a function of a first pressure differential derived from the pressure upstream of and the pressure downstream of the multiway valve and of a second pressure differential derived from the pump delivery pressure and the maximum consumer load pressure.

This type of controller is disclosed in German Patent DE-PS 34 22 165 and is particularly advantageous in combination with a load-sensing regulator. The pump usually has a discharge volume adjustment, which is load-sensing regulated. The load-sensing regulation creates a discharge volume adjustment of the pump as a function of the hydraulic energy required by the consumers. Thus, only the amount of pressure medium which is actually required is delivered by the pump so that circulation and throttling losses are minimized.

If no consumer is actuated because the multiway valves are closed, the pump is set for a slight delivery volume which only delivers overflow oil at a delivery pressure determined by a governor spring acting on a load-sensing regulator having two control pressure chambers. One control pressure chamber is acted upon by pump pressure and the other control pressure regulator is acted upon by the maximum consumer pressure and by the governor spring which provides a spring force equivalent to a pressure of 20 bar.

As long as no consumer is actuated and the control pistons inside the multiway valves assigned to the consumers are in the zero position, the pump will deliver only enough pressure medium so that the pump pressure on the load-sensing regulator equals the force of the spring on the opposite side of the load-sensing regulator to maintain equilibrium.

By displacing the control piston in a multiway valve, which is located ahead of a consumer, the pump is connected to that consumer, such that the pump pressure continues to that consumer. The displacement of the control piston in the multiway valve acts as a metering throttle. At the same time, the load pressure, namely the pressure in the line between the multiway valve which is actuated and the consumer being controlled, acts load-sensing regulator so that the pump receives a signal to increase the delivery volume and thus the pump pressure increase.

The consumer is then set in motion and a pressure gradient, $\Delta p$, is produced in the metering throttle. Equilibrium occurs in the system if the pressure gradient, $\Delta p$, in the multiway valve matches the force of the spring in the load-sensing regulator. The supply of fluid delivered by the pump is thus automatically adapted to the supply required. The multiway valve upstream of the pertinent consumer is actuated through a hand lever, which is adjustable in proportion to the quantity of the pressure medium, reaches the consumer so that the pressure gradient, $\Delta p$, in the multiway valve always remains constant. Thus, a supply of pressure medium dependent only on the position of the control piston and independent of the load pressure on the consumer always flows through the metering throttle.

Load-sensing regulation will function with several consumers since the maximum load pressure is sensed through a two-way valve chain and is passed to the load-sensing regulator. However, the load-sensing regulation reacts only on the maximum load pressure in the case of several controlled consumers so that the control openings in the multiway valve, which act as metering throttles, of the consumer with a lower load pressure must be newly regulated to compensate for the greater pressure gradients there due to the increased amount delivered by the pump to assure that the speeds of several consumers remain identical even though one consumer is suddenly loaded more heavily than another. Furthermore, at least the ratio of the speed of different consumers to each other is to be maintained if the maximum delivery volume of the pump is exhausted. For this purpose, an additional valve acting as a pressure compensator is located between the pump and the multiway valves. A control pressure chamber of the pressure compensator that is to be loaded in the closing direction is acted upon by the pressure ahead of the multiway valve and its control pressure chamber to be loaded in the opening direction is loaded by the pressure between the multiway valve and the consumer, i.e., by the assigned consumer pressure. An additional control pressure chamber acting in the closing direction is loaded by the pressure of the consumer which is acted upon by the highest load pressure, and an additional control pressure chamber acting in the opening direction is loaded with the pressure in the pump delivery line. Thus, two pressure differences exist. The first pressure difference results from the load pressure of the assigned consumer and the pressure upstream of the multiway valve throttling in the intermediate position, and the second pressure difference results from the opposite switching of the pump delivery pressure and the load pressure of the most highly loaded consumer. It is also possible not to form the pressure differences directly on the pressure compensator and feed the results, e.g., in the form of control pressures to the pressure compensator and allow it to act against a spring force. In any case, the pressure compensators compensate for differences between the pertinent consumer pressure and the highest load pressure. The consumer streams thus behave in accordance with the cross sections of the individual metering throttle openings.

The multiway valves with built-in volume governors distribute the pump stream load independently in relation to the throttle openings on the control piston so long as the stream delivered by the pump matches the sum of the streams absorbed by the consumers. If the sum of the consumer streams exceeds the maximum delivery stream of the pump, the maximum delivery stream is distributed to the consumers in proportion to the opening of the multiway valves assigned to the consumers.

When this system is used, e.g., on an excavating machine, the path line created by two simultaneously controlled operating cylinders of a dredge bucket is maintained at all times, and only when the maximum pump delivery stream is exceeded is the speed of the path line reduced. The ratio of the speeds of the controlled consumers is a function of the ratio of the throttle openings in the actuated multiway valves. The pressure drop is always the same in all multiway valves and corresponds to the regulating pressure difference at the load-sensing regulator. Manual intervention of the multiway valves by the operator is required to effect changes in the ratio of the speeds of the consumers. In particular, great dexterity is required if the path lines are to be traversed with precision.

The present invention proposes a relatively simple controller of the above type, with which changes in the ratios of the speeds of the consumer movements can be made independently of the multiway valves. This is achieved according to the invention by adjusting at least one of the pressure differences on at least one pressure compensator. The equilibrium is thus shifted at the pressure compensator involved and the pressure between the pressure compensator and multiway valve is modified, which results in a change in the pressure drop at the multiway valve and thus a change in the pressure stream and the consumer speed. Accordingly, the invention automatically adjusting regulating pressure gradients are deliberately maintained adjustable at at least one of the pressure compensators in order to be able to control the ratio of the speeds of the consumers.

In an advantageous embodiment of the invention, a pressure compensator is acted upon by a pressure derived from the pressure downstream of the assigned multiway valve and by a pressure derived from the pump pressure in the opening direction and by a pressure derived from the pressure upstream of the multiway valve and by a pressure derived from the highest load pressure of all the consumers in the closing direction. Active surfaces for the pressures are provided in the pressure compensator to which pressure lines are connected. This is accomplished by installing a device that influences the pressure in at least one of the pressure lines. For an arbitrary modification of the delivery stream distribution, one of the four limiting quantities determining the equilibrium at the pressure compensator is deliberately altered to influence the opening and closing forces at the pressure compensator and thus the flow of the pressure medium stream through the metering throttles formed by the control pistons of the multiway valve.

According to another embodiment of the invention, the pressure-influencing device is designed as a pressure-reducing valve. The pressure-reducing valve can be fixed or adjustable. It is particularly favorable if adjustment is by remote control, e.g., electrically, so that the nominal value in the line having the pressure-reducing valve can be modified by the operator. The adjustment can be program-controlled.

Instead of fixed or adjustable pressure-reducing valves, an embodiment of the invention influences the pressure by a throttle located in a line, and an additional throttle with a pressure-limiting valve is located in a discharge line branching off the downstream of the first throttle. This throttle combination serves the same purpose as a pressure-reducing valve.

The device which influences the pressure can be installed in a line carrying the pump pressure which leads to the active surface of the pressure compensator of one of the consumers or in a line carrying the highest consumer pressure which leads to the active surface of the pressure compensator of one of the consumers. Combinations of this arrangement are also possible. In principle, it is possible to influence the amount of pressure medium which flows through the multiway valves by influencing the revertive pressures of the multiway valves, i.e., the pressures upstream of and downstream of the multiway valves.

These as well as other features and advantages of the invention will become more apparent from the detailed specification and the accompanying drawings wherein like reference characters refer to like parts. Although the invention is disclosed in greater detail in the drawings, these drawings are supplied for the purpose of illustration without limiting the invention.

DESCRIPTION OF THE PREFERRED EMBODIMENTS

Figure 1:
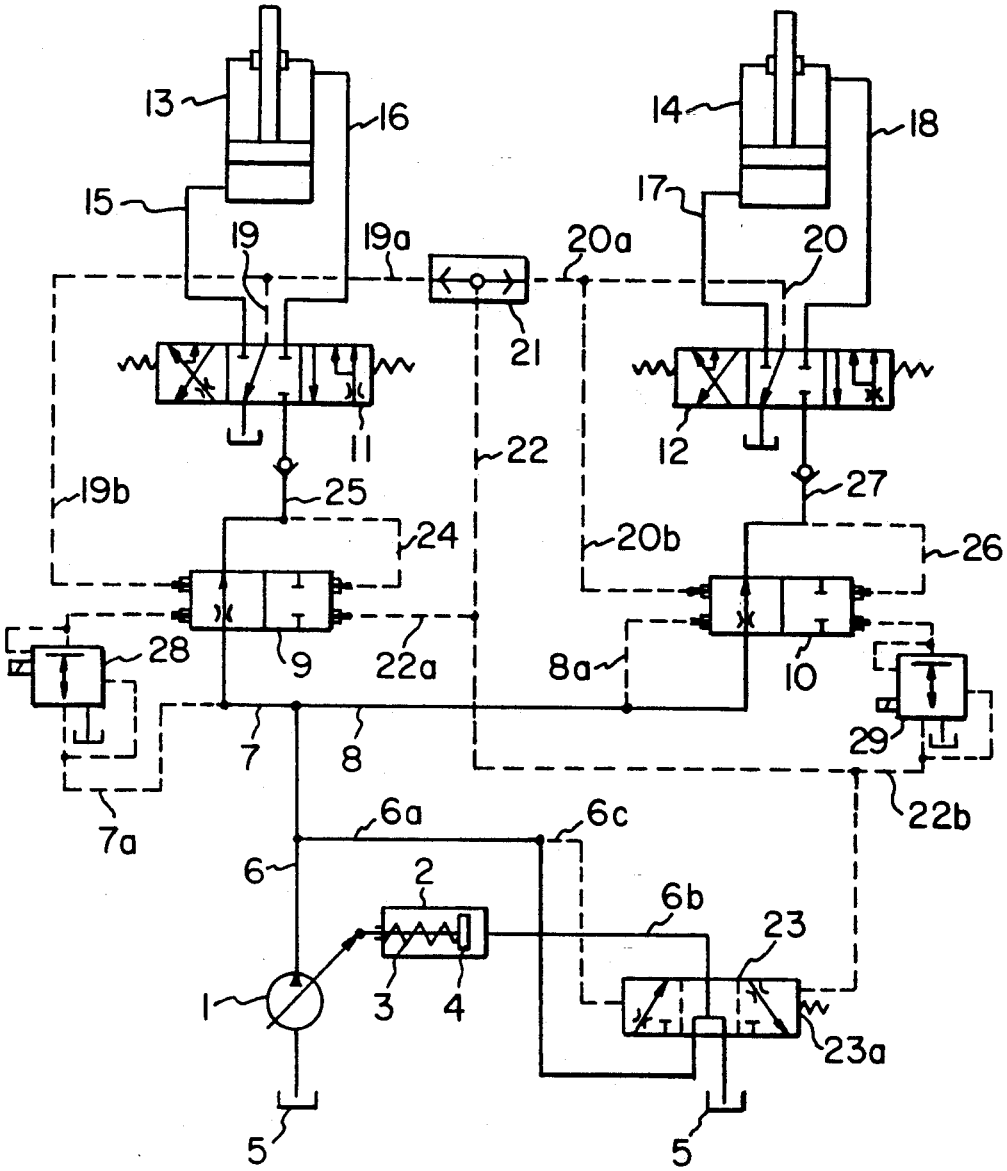
FIG. 1 shows a switching arrangement according to the invention with two consumers.

The delivery volume of a hydraulic pump 1 is adjusted by a servo piston 4 in an actuating cylinder 2 which is moveable against the force of a spring 3. Pump 1 pumps a pressure medium from a reservoir 5 into a delivery line 6, which divides into two branch lines 7 and 8. Branch lines 7 and 8 lead, respectively, to pressure compensators 9 and 10. Each pressure compensator is designed as a two-position/two-connection directional valve having open and closed positions. Spring-centered multiway valves 11 and 12 that throttle in intermediate positions are installed downstream of pressure compensators 9 and 10. The multiway valves control consumers 13 and 14 which, in this example, are cylinder-piston assemblies.

Multiway valve 11 is connected to consumer 13 by lines 15 and 16 and multiway valve 12 is connected to consumer 14 by lines 17 and 18. In the controlled state of consumer 13 or consumer 14, one of lines 15 or 16 or one of lines 17 or 18 is connected with a line 19 or 20 which is connected to one of multiway valves 11 and 12. Thus, lines 19 and 20 carry the load pressure of a consumer. Lines 19 and 20 are connected to branch lines **19*a* and 20*a* which empty into opposite ends of a changeover valve 21. The greater of the pressures which are present in lines 19*a* and 20*a*, i.e., the higher load pressure of either consumer 13 or consumer 14, is passed by changeover valve 21 to a line 22, which is connected to a first end of a load-sensing regulator 23. Load-sensing regulator 23 is also connected to a line 6*a* which branches off delivery line 6. A line 6*b* connects load-sensing regulator 23 with the operating face of cylinder 2 in servo piston 4. A line 6*c* branches off line 6*a* and is connected to a second end of load-sensing regulator 23. A pressure spring 23*a* is located on the first end of load-sensing regulator 23. Load-sensing regulator 23 has three switching positions. In the first switching position, line 6*a* is connected to line 6*b* and thus with servo piston 4. In the second switching position, lines 6*a* and 6*b* are directly connected to a reservoir 5, and in the third switching position, line 6*a* is shut off and line 6*b* is connected to reservoir 5**.

Each pressure compensator 9 and 10 has four active surfaces, two of which are located in the opening direction of the valve and two in the closing direction. At pressure compensator 9, a line **19*b* branches off line 19 to a first active surface working in the opening direction. A line 7*a* branches off line 7 to a second active surface working in the opening direction. A line 22*a* branches off line 22 and a line 24 branches off line 25** to the active surfaces working in the closing direction.

Line 25 connects the pressure compensator to multiway valve 11.

Analogously, at pressure compensator 10 a line 20*b* branches off line 20 and a line 8*a* branches off line 8 to the acting surfaces acting in the opening direction. A line 22*b* branches off line 22 and a line 26 branches off a line 27 to the active surfaces working in the closing direction. Line 26 connects piston 10 to multiway valve 12. Pressure-reducing valves 28 and 29 are, respectively, located in lines 7*a* and 22*b*.

The controller operates as follows. When consumers 13 and 14 are not actuated, multiway Valves 11 and 12 are in the middle position and thus lines 15 and 16: lines 17 and 18: and lines 19, 19*a*, 19*b*, 20, 20*a*, 20*b* and 22 are pressureless. The construction of pump 1 is such that spring 3 is always striving to move servo piston 4 into a position corresponding to the maximum delivery volume of the pump. When pump 1 begins to deliver fluid, a pressure builds up in line 6, multiway valves 11 and 12 are closed and the pressure is distributed through lines 6*a* and 6*c* to the second end of load-sensing regulator 23. Load-sensing regulator 23 is in the third switching position due to the force of spring 23*a* which corresponds to a pressure of 20 bar, and in this position, line 6*b* is connected to reservoir 5. As the pump delivery pressure increases, load-sensing regulator 23 moves to the right as shown in FIG. 1 until line 6*a* is connected with line 6*b* and the delivery volume of pump 1 is reduced. Equilibrium sets in between the spring force and the pump delivery pressure at load-sensing regulator 23. Thus, pump 1 delivers only a minute stream of pressure medium when the consumers are not actuated and maintains a delivery pressure of 20 bar.

If one of the multiway valves 19 or 20 is actuated to control the pertinent consumer, the servo piston in that multiway valve is displaced and a connection is made between pump and consumer 13, in which case an arbitrarily selected cross section is freed to supply the consumer with a definite stream of pressure medium to achieve a definite travel speed of the consumer. If the pump pressure exceeds the load pressure, consumer 13 is set in motion and the pressure 10 medium creates a pressure drop $\Delta p$ at the free cross section in multiway valve 11. In principle, the free cross section represents a metering throttle. Equilibrium occurs in the system if the pressure drop at the metering throttle matches the pretensioning of spring 23*a* in load-sensing regulator 23. Any change in the metering throttle opening causes a change in the pressure drop $\Delta p$ at the multiway valve, which is regulated through load-sensing regulator 23 so that a constant pressure gradient is always maintained at the multiway valve. The result is that a stream of pressure medium, independent of the load pressure and thus constant and dependent only on the opening width, flows through the metering throttle. The delivery stream of the pump is automatically adapted to the stream required.

If multiway valve 12 is now actuated simultaneously with multiway valve 11 and thus consumer 14 is additionally controlled, the higher load pressure, e.g., the load pressure of consumer 13, is transmitted by changeover valve 21 to the spring end of load-sensing regulator 23. The pressure gradient at multiway valve 12 of the lesser-loaded consumer 14 will increase and a readjustment of the multiway valve by the operator is required to maintain the desired consumer speed. Pressure compensators 9 and 10 are provided to compensate for these pressure gradient changes.

In the following analysis, the actions of pressure-reducing valves 28 and 29 on the pressure compensators are disregarded. Two pressure differences are produced at each of pressure compensators 9 and 10. A first pressure difference arises from the opposite switching of the load pressure carried in line 19*b* or line 20*b* against the pressure in lines 24 or 26 ahead of the multiway valves 11 or 12. The second pressure difference is formed by the opposite switching of the pump delivery pressure in line 7*a* or line 8*a* against the higher pressure in line 22*a* or line 22*b*.

It is assumed in this example that the load pressure at consumer 13 is higher thantheload pressure at consumer 14. This higher load pressure is communicated through line 22*a* to pressure compensator 9. Because the same load pressure is also present on the opposite end in line 19*b*, the pressures cancel each other. The pump delivery pressure present in line 7*a* corresponds to a higher load pressure increased by $\Delta p$. The pressure in line 24 ahead of multiway valve 11, which is essentially the same as the pump delivery pressure, acts against this pressure. An equilibrium thus prevails at pressure compensator 9, which remains open.

Pressure compensator 10 of consumer 14 is acted upon through line 22*b* with the higher load pressure, namely the load pressure of consumer 13. A disequilibrium thus arises at valve 10, so that the latter is moved in the direction of the closing position and thus a throttling action develops which assures that the pressure in line 27 drops to a value that is sufficiently great so that the prescribed $\Delta p$ value is attained in multiway valve 12, e.g., 20 bar, in this example. The value $\Delta p$ is thus identical for the metering throttles of both multiway valves 11 and 12 and the consumer streams, thus behave according to the ratio of the metering throttle openings.

In order to modify the ratio of the consumer streams and thus the ratio of the working speeds independently of the cross section of the metering throttle openings, one or more of the limiting quantities acting on each pressure compensator is arbitrarily and controllably modified according to the invention. This can occur on one or both pressure compensators. Pressure-reducing valve 28 may be fixed; may be adjustable in fixed stages; or may be continuously adjustable electrically, causing a reduction in the pump delivery pressure acting on valve 9 in line 7*a*, provided that the valve is in a pressure-reducing setting so that a displacement occurs in the direction of the closing setting in valve 9 and thus a throttling action occurs. The pressure in line 25 is thus reduced in comparison with the pressure in line 7 by which the pressure gradient $\Delta p$ at multiway valve 11 is reduced along with the speed of consumer 13 while the load pressure remains unchanged.

Pressure-reducing valve 29 in line 22*b* causes a reduction in the higher load pressure acting on pressure compensator 10 and thus a shift in equilibrium in the direction of the opening of pressure compensator 10, provided it is in a pressure-reducing setting. A throttling action otherwise present in valve 10 is thus reduced or cancelled (if consumer 14 has a lower load pressure than consumer 13). Consequently, the pressure in line 27 is equal to or only slightly reduced compared to the pressure in the line 8 by which the pressure gradient is increased at multiway valve 12 and thus the speed of consumer 14 with an unchanged load pressure in consumer 14.

Pressure-reducing valves 28 and 29 can be adjusted manually or can be automatically program-controlled.

It will be understood by those skilled in the art that pressure-reducing valves or other pressure-influencing devices can be provided in lines 19*b*, 24, 20*b* and 26.

Figure 2:
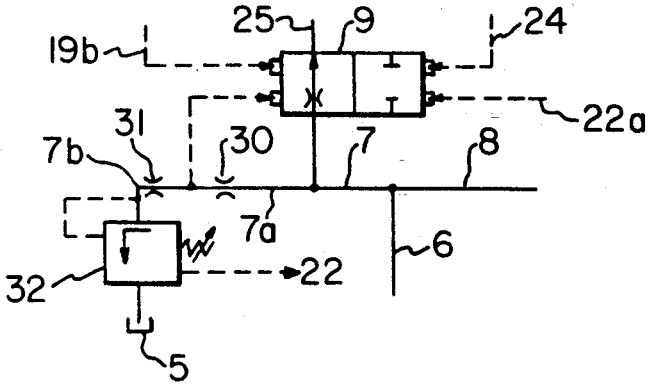
FIG. 2 shows a second embodiment of the switching arrangement shown in FIG. 1.

Instead of pressure-reducing valves, it is possible to install a combination throttle as shown in FIG. 2 of the drawings. In FIG. 2, a throttle 30 is installed in line 7*a* instead of pressure-reducing valve 28. A discharge line 7*b* branches off line 7*a* downstream from throttle 30 and another throttle 31 is located in line 7*b*. A pressure-limiting valve 32 is installed in line 7*b* downstream of throttle 31. As soon as pressure-limiting valve 32 opens, pressure medium flows into the reservoir 5 and a pressure drop arises at throttle 30. The pump delivery pressure reduced by this pressure drop is passed on to pressure compensator 9. Pressure-limiting valve 32 is acted upon in this example by the highest load pressure in addition to the spring force in the closing direction. The openings of throttles 30 and 31 are dimensioned so that the pressure acting on pressure-limiting valve 32 in the opening direction is always greater than the highest load pressure in order to assure the opening of the pressure-limiting valve. In order to stop operation, the adjustable spring of pressure-limiting valve 32 can be pretensioned so that the pressure-limiting valve remains closed.

The foregoing describes preferred embodiments of the invention and is given by way of example only. The invention is not limited to any of the specific features described herein, but includes all such variations thereof within the scope of the appended claims.

I claim:

1. A hydraulic system including a hydraulic pump having a discharge line, a plurality of hydraulic energy consumers connected to said pump and a controller for the load-independent distribution of a pressure medium from said hydraulic pump to said hydraulic energy consumers, a multiway valve having intermediate throttling positions operatively connected between said hydraulic pump and each of said hydraulic energy consumers to actuate said hydraulic energy consumers, a pressure compensator for determining the flow of pressure medium to each of said multiway valves located upstream of each of said multiway valves, each of said pressure compensators being acted upon by a pressure resulting from the pressure downstream of the assigned multiway valve and by a pressure resulting from the pressure of said hydraulic pump in the opening direction and by a pressure resulting from the pressure upstream of the assigned multiway valve and by a pressure resulting from the highest load pressure of all of said plurality of hydraulic energy consumers in the closing direction, each of said pressure compensators having active surfaces for the pressures, pressure lines connected to said pressure compensators to supply pressure medium to said active surfaces, and a pressure reducing valve for adjusting at least one of the pressures located in at least one of said pressure lines.

2. A system as set forth in claim 1, wherein said pressure-reducing valve includes adjustment means.

3. A system as set forth in claim 2, wherein said pressure reducing valve is located in said pressure line between said hydraulic pump and one of said active surfaces of a pressure compensator for one of said consumers.

4. A system as set forth in claim 2, wherein said pressure reducing valve is located in said pressure line between the highest consumer pressure and one of said active surfaces of a pressure compensator for one of said consumers.

5. A system as set forth in claim 2, wherein said adjustment means for said pressure-reducing valve is electrically controlled.

6. A system as set forth in claim 5, wherein said pressure reducing valve is located in said pressure line between said hydraulic pump and one of said active surfaces of a pressure compensator for one of said consumers.

7. A system as set forth in claim 5, wherein said pressure reducing valve is located in the line carrying the highest consumer pressure and one of said active surfaces of a pressure compensator for one of said consumers.

8. A system as set forth in claim 1, wherein said pressure reducing valve is located in said pressure line between said hydraulic pump and one of said active surfaces of a pressure compensator for one of said consumers.

9. A system as set forth in claim 1, wherein said pressure reducing valve is located in said pressure line between the highest consumer pressure and one of said active surfaces of a pressure compensator for one of said consumers.

* * * * *

UNITED STATES PATENT AND TRADEMARK OFFICE

CERTIFICATE OF CORRECTION

PATENT NO. : 5,237,908

DATED : August 24, 1993

INVENTOR(S) : Walter Kropp

It is certified that error appears in the above-identified patent and that said Letters Patent is hereby corrected as shown below:

Column 5 Line 12 "Valves" should read --valves--.

Column 5 Line 13 "16:" should read --16;--.

Column 5 Line 14 "18:" should read --18;--.

Column 5 Line 37 after "pump" insert --1--.

Column 5 Line 42 "pressure 10 medium" should read --pressure medium--.

Column 6 Line 13 "thantheload" should read --than the load--.

Signed and Sealed this

First Day of March, 1994

Bruce Lehman

*Attest:*

BRUCE LEHMAN

*Attesting Officer*

*Commissioner of Patents and Trademarks*